United States Patent [19]

Swanson

[11] Patent Number: 4,468,316

[45] Date of Patent: Aug. 28, 1984

[54] HYDROGENATION OF ASPHALTENES AND THE LIKE

[75] Inventor: Rollan Swanson, Beatty, Nev.

[73] Assignee: Chemroll Enterprises, Inc., New York, N.Y.

[21] Appl. No.: 471,687

[22] Filed: Mar. 3, 1983

[51] Int. Cl.[3] ..... C10G 47/06

[52] U.S. Cl. ..... 208/59; 208/108; 208/112; 512/344

[58] Field of Search ..... 208/108, 111, 112, 10; 252/439

[56] References Cited

U.S. PATENT DOCUMENTS

| | | | |
|---|---|---|---|
| 1,300,816 | 4/1919 | Cobb | 208/229 |
| 1,413,005 | 4/1922 | Cobb | 208/230 |
| 1,904,586 | 4/1933 | Winkler et al. | 208/8 R |
| 1,938,672 | 12/1933 | Ruthruff | 208/230 |
| 1,974,724 | 9/1934 | Rosenstein | 208/229 |
| 2,145,657 | 1/1939 | Ipatieff et al. | 208/143 |
| 2,950,245 | 8/1969 | Thomsen | 208/348 |
| 3,112,257 | 11/1963 | Dauwes | 208/216 R |
| 3,185,641 | 5/1965 | Cowden | 208/226 |
| 3,252,774 | 5/1966 | McMahon et al. | 48/214 R |
| 3,354,081 | 11/1967 | Aldridge | 208/235 |
| 3,368,875 | 2/1968 | Tulleners | 422/190 |
| 3,382,168 | 5/1968 | Wood et al. | 208/264 |
| 3,483,119 | 12/1969 | Ehrler | 208/264 |
| 3,553,279 | 1/1971 | Dawa | 585/635 |
| 3,565,792 | 2/1971 | Haskett | 208/208 M |
| 3,617,529 | 11/1971 | Thompson et al. | 208/210 |
| 3,663,431 | 5/1972 | Warner | 208/143 |
| 3,787,315 | 1/1974 | Bearden, Jr. et al. | 208/208 M |
| 3,788,978 | 1/1974 | Bearden, Jr. et al. | 208/208 M |
| 3,816,298 | 6/1974 | Aldridge | 208/112 |
| 3,933,475 | 1/1976 | Swanson | 75/21 |
| 3,957,503 | 5/1976 | Swanson | 75/77 |
| 3,960,706 | 6/1976 | McCollum et al. | 208/112 |
| 4,003,823 | 1/1977 | Baird, Jr. et al. | 208/108 |
| 4,007,109 | 2/1977 | Baird, Jr. et al. | 208/108 |
| 4,018,572 | 4/1977 | Swanson | 44/1 R |
| 4,057,422 | 11/1977 | Swanson | 75/86 |
| 4,078,917 | 3/1978 | Swanson | 75/101 R |
| 4,104,200 | 8/1978 | Cronauer et al. | 208/10 |
| 4,119,528 | 10/1978 | Baird, Jr. et al. | 208/108 |
| 4,147,611 | 4/1979 | Miasek et al. | 208/108 |

FOREIGN PATENT DOCUMENTS

| | | |
|---|---|---|
| 161778 | 3/1955 | Australia . |
| 597489 | 5/1960 | Canada . |
| 590724 | 7/1947 | United Kingdom . |

OTHER PUBLICATIONS

Biltz, Wilhelm et al., "Ueber die Pentasulfide des Rubidiums und Casiums", *Berichte,* Part I, pp. 123–130, 1905.

Kuster, F. W., "Beitrage zur Kenntnis der Polysulfide. II.", *Z. Anorg. Chem.,* vol. 44, pp. 431–452, 1905.

Letoffe, et al., "Determination des Enthalpies de Formation Polysulfures de Potassium," *Journal de Chimie Physique,* 71, pp. 427–430, 1974.

Bloxam, W. Popplewell, "Hydrosulphides, Sulphides, and Polysulphide of Potassium and Sodium", *J. Chem. Soc.,* vol. 77, pp. 753–770, 1900.

Bloxam, W. P., "The Sulphides and Polysulphides of Ammonium", *J. Chem. Soc.,* vol. 68, pp. 277–309, 1895.

Thomas, John S. and A. Rule, "The Polysulfides of the Alkali Metals", *Journal Chemical Soc.,* Part 3, pp. 1063, 1917.

Yu, Falbe, Ed., *Chemical Substances from Coal,* FIG. 47; trans. from German by A. B. Vol–Epstein, Moscow, "Chima" Publishers, 1980.

Biltz and Wilke–Dorfurt, *Z. Anorg. Chem.,* vol. 48, pp. 297–318, 1906 (See also *Bor.,* pp. 43–53, 1905).

van Krevelen et al., *Fuel,* 38, 256, 1959.

Mazumdar, B. K., et al., *Fuel,* 41, 121–128, 1962.

Hugot, *Ann. Chim. Phys.,* vol. 21, pp. 5–87, at 72, 1900.

Klemm, W., *Z. Anorg. Chem.,* band 241, pp. 281–304, 1939.

Bergstrom, F. W., *J. Amer. Chem. Soc.,* vol. 48, pp. 146–151 at 147, 1926.

Feher, F. and H. Berthold, *Z. Anorg. Chem.,* pp. 245–249 at 247, 1953.

Thomas and Rule, *J. Chem. Soc.,* 2819, 1914.

Eibeck, R. E., *Dissert. Abstract,* Ann Arbor, Mich., 21, p. 3254, 1961.

Renegade and Costeanu, *Compt. rend.,* L. 156, pp. 791–793, 1913.

Renegade and Costeanu, *Academie des Sciences,* Seance due 30 Mars 1914, pp. 940–946, (1914).

Sabbatier, *Ann. Chim. Phys.,* 22, pp. 5–97, 1881.

Marrony, *J. Chim. Phys.*, 56, 214–221, 1959.
Auroux, Mme. Aline, *C.R. Acad. Soc.* Paris, 274, pp. 1297–1300, Mar. 1972.
Kuster und Heberlein, "Beitrage zur Kenntnis der Polysulfide", *Z. Anorg. Chem.*, pp. 53–84, Nov. 1904.
Hamburger, Anna, "Uber die Festen Polyjodide der Alkalien, ihre Stabilitat und Existenzbedingungen bei 25°", *Z. Anorg. Chem.*, vol. 50, pp. 403–438, 1906.
"Alicyclicity of Coals: An Appraisal", *Fuel*, vol. XLI, pp. 105–111, 1962.
"Dehydrogenation of Coal by Iodine", *Fuel*, vol. 39, pp. 179–182, 1960.
"Dehydrogenation of Coal and Tar Formation", *Fuel*, vol. 37, pp. 112–119, 1959.
Foppl, H. et al., "Die Kristallstrukturen von —$Na_2S_2$ und $K_2S_2$, —$Na_2S_2$ und $Na_2Se_2$", *Z. Anorg. und Allgemeine Chem.*, Band 314, pp. 12–20, 1962.
Helms, Alfred et al., "Die Struktur der sogenannten" Alkalitetroxyd *Z. Anorg. und Allgemeine Chem.*, Band 241, pp. 96–106, 1939.
Goubeau, Josef et al., "Das System Kaliumsulfat–Kaliumsulfid", *Z. Anorg. und Allgemeine Chem.*, Band 236, pp. 45–56, 1938.
Klemm, Wilhelm, "Das magnetische Verhalten der Kaliumpolyoxyde und -polysulfide", *Z. Anorg. und Allgemeine Chem.*, Band 225, pp. 273–280, 1935.
Mazumdar, B. K., "Alicyclicity and Smoke Emission of Coal", *Nature*, vol. 183, p. 1613, Apr. 4, 1959.
Mazumdar, B. K., "Dehydrogenation Studies on Coal", *Journal of Scientific & Industrial Research* (India), vol. 17, pp. 509–511, 1958.
Pearson, Thomas Gibson et al., "The Polysulfides of the Alkali Metals, Part III, Potassium", *J. Chem. Soc.*, Part I, pp. 1304–1314, 1931.
Thomas, John Smeath et al., "The Polysulphides of the Alkali Metals, Part V, The Monosulphide and Disulphide of Lithium", *J. Chem. Soc.*, vol. 125, Part II, pp. 2207–2219, 1924.
Thomas, John Smeath et al., "The Polysulphides of the Alkali Metals, Part IV, The Polysulphides of Ammonium," *J. Chem. Soc.*, vol. 123, Part II, pp. 1726–1738, 1923.
Thomas, John Smeath et al., "The Sulphides of Ammonium", *J. Chem. Soc.*, vol. 123, pp. 1181–1189, 1923.
Pollitzer, F., "Uber das Gleichgewicht der Reaktion $H_2S+2J-2HJ+S$ und die Dissoziation des Schwefelwasserstoffs", *Z. Anorg. Chem.*, vol. 64, pp. 121–148, 1909.

*Primary Examiner*—Delbert E. Gantz
*Assistant Examiner*—Anthony McFarlane
*Attorney, Agent, or Firm*—Fred A. Keire

[57] ABSTRACT

A process for converting, into lighter viscosity products, heavy fractions from petroleum or other hydrocarbon refining, e.g. asphaltenes; catalysts especially suitable therefor and a process for this conversion have been disclosed; by further upgrading, the obtained products can be usefully employed as fuels and the like.

16 Claims, 1 Drawing Figure

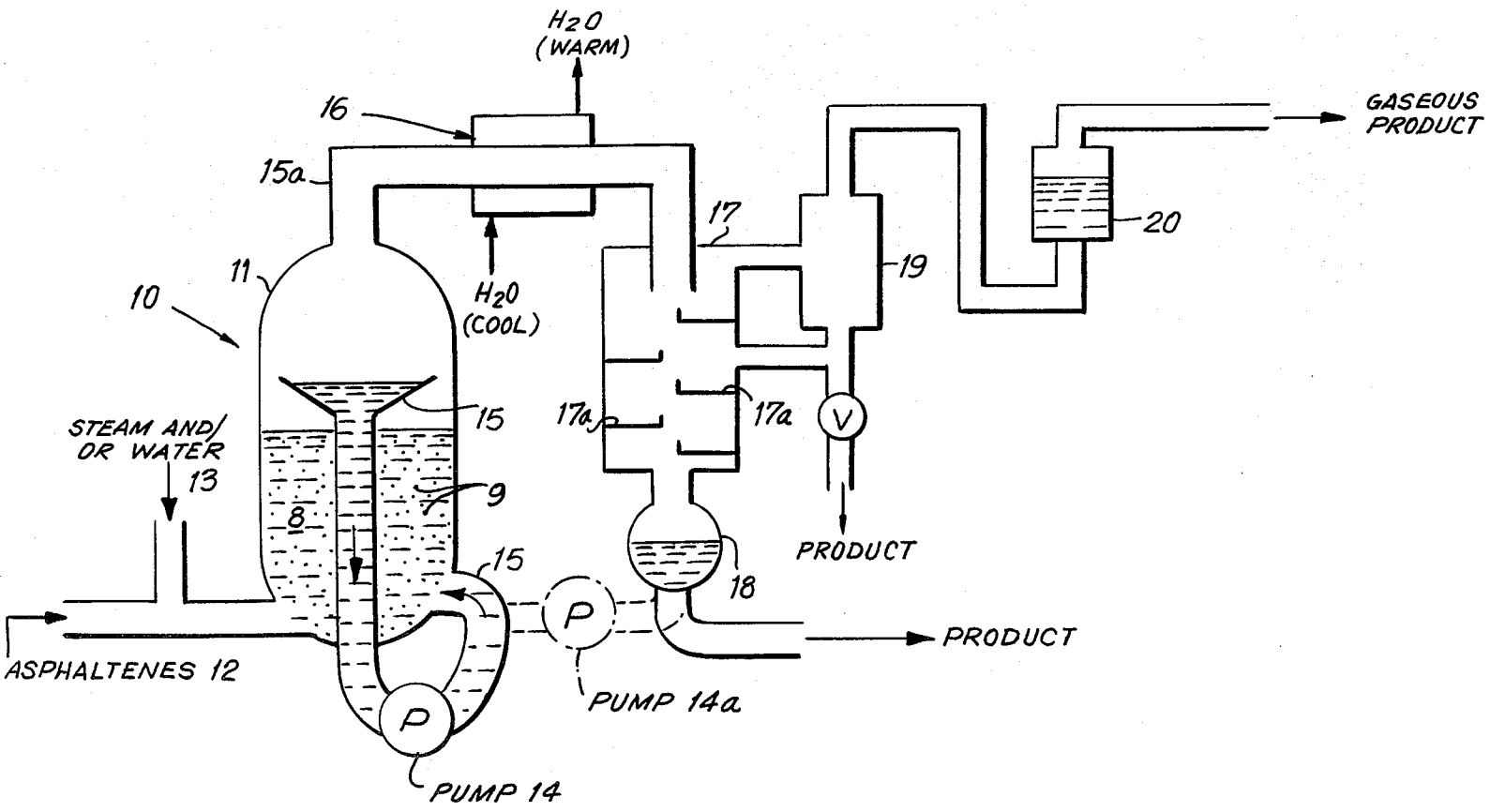
GASEOUS PRODUCT
20
19
V
PRODUCT
PRODUCT
17
17a
18
PUMP 14a
$H_2O$ (WARM)
17a
P
$H_2O$ (COOL)
15
9
15
PUMP 14
P
16
15a
8
11
10
STEAM AND/ OR WATER
13
ASPHALTENES 12

HYDROGENATION OF ASPHALTENES AND THE LIKE

This invention relates to the treatment of heavy bottom fractions obtained in hydrocarbon refining, i.e. oil, resin, and asphaltene fractions (commonly designated as ORA) which are the residual fraction left from petroleum refining and comprises of the components especially refractory to further treatment such as catalytic cracking, thermal cracking and the like. More specifically, this invention pertains to the treatment of asphaltic residues, that is asphaltenes as part of the bottoms component or as solvent extracted asphaltenes. Naturally occurring asphaltic materials are also included within the scope of this invention. The process is carried out in one or two stages with catalysts which very advantageously cleave or cause scisions in the asphaltene, bitumen, or resin molecules converting these to lighter viscosity products. In a specific aspect of this invention, the asphaltenes obtained by solvent extraction from the refining of petroleum and the like residues have been subjected to the treatment of the especially advantageous catalyst causing the asphaltenes to undergo cleavage and/or hydrogenation in one or more stages producing considerably lighter products.

PRIOR ART

In general, the prior art has attempted upgrading of the heavy petroleum fractions with indifferent success, asphaltenes in the bottom fractions have been especially refractory to further treatment. By stripping the oil component from the bottoms such as by steam stripping and the like or by hydrogen transfer reactions, these bottom fractions have been improved and/or further components obtained, albeit of a low quality. For example, by using a hydrogen donor solvent, some of the hydrogen from the solvent is transferred to the high boiling fraction. Typically, this reaction is carried out at very high temperatures and without or with the presence of hydrogen under high pressure.

Other methods have obtained hydrogen from residues by stripping it from part of the very refractory residues and thus coking part of the residue. The excess hydrogen is used to augment hydrogen elsewhere in the refining cycle or used in tandem with the hydrogen transfer solvent to improve the residues.

As a rough approximation, the refractory residues may constitute up to about one third of the volume of petroleum.

In my previous U.S. application Ser. No. 140,604 published on Nov. 18, 1981 in Great Britain as U.K. Patent Application No. 2,075,542, I have disclosed a process for hydrotreating carbonaceous materials in which the carbonaceous material is contacted with steam and with alkali metal hydrosulfides, or the empirical monosulfides or polysulfides and hydrates thereof and mixtures of the foregoing to hydrocrack, hydrogenate, denitrogenate, and/or demetallize and/or desulfurize the carbonaceous material.

According to the disclosed process, the treatment of petroleum and petroleum residues have been considerably improved based on yield, conversion per pass, space/time velocity, such that the process produces upgraded products of greater value.

In my U.S. Pat. Nos. 4,366,044 and 4,366,045, a number of prior art references are also mentioned pertaining to this general field of art. For sake of convenience, these patents and the prior art cited in these patents is incorporated by reference herein. This prior art, however, does not disclose the herein disclosed specific invention.

BRIEF DESCRIPTION OF THE INVENTION

The present invention distinguishes from the prior art in the specific catalyst which is being used preferably in a supported form, to attack the extremely refractory petroleum residue components such as boiling over 1,000° F. and usefully convert these residue components into highly desirable lighter viscosity products in a highly efficacious manner.

My present invention further distinguishes from the prior art in that the reaction is specifically attacking the most refractory components of the residue such as asphaltenes, while at the same time avoiding, due to the discovery of the catalytically aided thermal decomposition by the herein used catalysts, the unfavorable effects of coke formation which may occur if the process is not carried out properly. Moreover, further process advantages are realized by the employment of an ebullient bed reactor, by carrying out the process continuously and at higher temperatures such as up to 650° C., yet at the same time quenching the conversion product to obtain a desired end product in another reactor(s) in combination with the first reactor.

In accordance with the present invention, the ORA fraction obtained from the residues such as from petroleum refining or refining of any other carbonaceous source yielding these fractions are being treated most advantageously by the present method. However, with outstanding results the present invention is useful for treatment of asphaltenes, e.g. of solvent extracted asphaltenes when these are being treated in one or two stages to further cleave and/or hydrogenate in one or two stages this especially refractory product and thus to improve the overall yield obtainable from a barrel of oil.

This improved process is also characterized by the ability of the specific catalyst to convert rhe Ramsbottom or Conradsen carbon into usefully hydrogenated products without affecting to any noticeable degree the process as practiced herein.

Still further, the present invention also provides for especially advantageous catalyst support combinations which can be used such as in an ebullient bed reactor and produce the conversion products in an especially advantageous manner without the catalyst support combination being affected by the unwanted metal constituents found in petroleum and accumulated predominantly in the ORA fraction.

Still further, it has been found that after the first stage conversion with the active catalysts, a quench stage may be provided where the cleaved product may be appropriately converted by a specifically selected catalyst in a second stage reaction to produce the predetermined and/or highly desired product cuts. However, the second stage reaction is interdependent and based on the specific catalyst in the first stage, and based on the properly carried out reaction in the first stage reactor.

Moreover, the present invention allows also a recycle of the product not adequately reacted in the first reactor and its subsequent conversion into the desired end product.

The above invention is characterized by and its accomplishments made evident from the improved product being obtained from the very poor starting material, the higher hydrogen content of the starting material, the lower viscosity and smaller molecular size of the cleaved product and the amenability of the treated product to further conventional treatment steps.

Inasmuch as the present invention accomplishes considerable hydrogenation which improves the yields, improves the product, and provides smaller molecules and thus a less viscous product and eliminates and/or minimizes to a very significant degree the presence of free Conradsen or Ramsbottom carbon, the attained end result shows an outstanding achievement in the continuous search for utilizing all fractions of a refinery product which heretofore could not be advantageously upgraded to the degree such as now disclosed herein.

ILLUSTRATION OF THE PROCESS BY A FLOW SHEET AND DESCRIPTION OF THE DRAWING

In the drawing herein, the FIGURE shows schematically a continuous process wherein the various source materials are converted into useful products.

As illustrated in the drawing, the first stage reactor is an ebullating bed reactor 10. It consists of a reaction vessel 11 with a catch funnel 15 at the top and a pump 14 for recirculating the fluid 8 products undergoing the reaction. The catalyst 9 which is in a dispersed-supported form is ebullating with the fluid 8. A fluid 8 undergoing the reaction including the catalyst 9 therefor may be made to circulate by the pumping of the fluid into the reactor and appropriately distributing the same. Typically, the circulating fluid might be introduced at the bottom, but introduction may be elsewhere in the reactor at one or more places. On a smaller scale, and as a close approximation of an ebullating bed reactor, a stirred tank is appropriate, provided the supported catalyst material is placed in a cage(s) or baskets such as four stainless steel mesh envelopes and these attached to a suitable frame driven by an external motor. By varying the speed of the rotation, e.g. 20 to 150 rpm, reactions very closely approximating those in an ebullient bed reactor are achieved. Again, it is important that adequate steam-catalyst-fluid contact take place to assure the desired result.

Circulatory fluidized bed reactors where the supported catalyst circulates with the fluid or fluidized bed reactors may also be suitable. Similarly, a fixed bed reactor with the fluid downflowing or upflowing may be used for that purpose.

A continuously introduced pre-heated feed charge such as asphaltenes or an ORA cut are introduced via pipe 12. Steam 13 may be introduced with the feed or its may also be distributed in reactor 10 throughout the fluid from the bottom of the reactor 10.

The obtained lighter viscosity fluids are conducted by a large diameter type or conduit 15*a* and appropriately cooled if needed in a quench zone 16 and then introduced in a second stage reactor 17. Although one reactor has been shown in the FIGURE, a number of reactors in series or in parallel may also be used. These reactors may be fixed catalyst bed, gaseous or vapor-phase reactors. A column where the catalyst is shown as supported on the trays 17*a* is typical. Other well known devices may be employed for this purpose such as trickle bed reactors and the like. The bottoms from the second reaction stage are collected in the collection zone 18. These are classified as No. 1 bottoms. These bottoms may be circulated entirely or partially into the ebullating reactor with the fluid collected by the ebullating bed funnel conduit 15. If necessary, a pump 14A may be used for that purpose. Part of the product may also be diverted and recovered for further processing. The top fraction from the second stage reactor 17 may be refluxed via reflux boiler 19 and the products may be diverted from this reflux boiler and the gaseous products therefrom further worked up in an additional reactor such as depicted as 17 but not shown herein; these are all called second stage reactors as distinguished from the first stage reactor 10 where the cleavage of the source material is carried out. The second stage reactor products and other gaseous products may be treated in a further reactor, such as by bubbling through an appropriate bath to remove any unwanted constituents such as hydrogen sulfide. This may be accomplished in a vessel 20 in which potassium hydroxide has been dissolved in a solution.

The gaseous products are thereafter recovered in a conventional manner.

DETAILED DESCRIPTION OF THE INVENTION

Typically an ORA fraction, that is oil, resin, asphaltene fraction, is described as one which boils at atmospheric pressure at a temperature above 1000° F. Although this is a rough description because the amount of oil, resin and asphaltene are not necessarily ascertained, it is a convenient measure for this the most refractory component in an oil being treated. It is known that asphaltenes can be solvent extracted from petroleum residues or from the ORA fraction to allow the oil and resin residue to be further treated. Asphaltenes, of course, are especially intractable to further treatment such as by catalytic or other means, and thus constitute a fraction which can only usefully be burned or coked to strip all available hydrogen therefrom.

A convenient characterization of the asphaltene is that it is that portion of the asphalt or bitumen which is soluble in carbon disulfide, but insoluble in paraffins, e.g. heptane, paraffin oil, or in ether. Resins from the ORA fraction may be extracted with propane. Bitumens are also soluble in carbon disulfide. Carbenes, which are constituents of bitumen, are insoluble in carbon tetrachloride but soluble in carbon disulfide. Further, the oily or soft constituent of bitumen is also named malthenes or maltenes. These are soluble in petroleum spirits. Malthenes are pentane soluble compounds and asphaltenes are pentane insoluble compounds.

Still further and in a broader sense, the natural asphalts such as petrolene, mineral pitch, earth pitch, Trinidad pitch, petroleum pitch, and native mixtures of hydrocarbons such as amorphous solid or semi-solid fractions produced by oxidation of residual oils are included within the above definition.

Inasmuch as there is no agreement on the exact definition of these compounds such as malthenes or asphaltenes, mixtures are often reported as one or the other in the prior art. Moreover, the solvents used and the extraction and precipitation techniques practiced affect to a lesser or greater degree the end product properties. For this reason, the solvent extracted asphaltenes such as carbon disulfide extracted asphaltenes precipitated from heptane are still not considered pure compounds as these have no specific melting points but only softening points. Asphaltene softening points may be up to 400° F. and higher. As a result, a convenient measure is to define the ORA fraction as one boiling at 1000° F. and higher, although this temperature limit is arbitrary and lower temperatures such as 900° F. may be selected because all of the material may not be desirably stripped away. Hence, a lower temperature of 800° F. merely characterizes a less intractable composition.

For example, a high softening point solvent extracted asphaltene will have a softening temperature of about 270° F., a specific gravity at 60° F. of about 1.1149 and a viscosity at about 275° F. of about 4060 poises. The specific gravity at 275° F. is 1.026, and thus the viscosity is 3,957 stokes or 395,700 cST (centistokes) (stokes are obtained by dividing the poises by a specific gravity at the indicated temperature). Viscosity at 300° F. of the same high softening point asphaltene is 877 poises with a specific gravity at 300° F. of 1.016, and 86,000 cST. Viscosity at 325° F. for this asphaltene is 261.5 poises, and specific gravity at 335° F. is 1.006 giving 26,000 cST.

The analysis for the above solvent extracted asphaltene is found in the following table.

ASPHALTENE ANALYSIS

| | | Metals | |
|---|---|---|---|
| Carbon | 84.59% | Fe | 360 ppm |
| Hydrogen | 8.80% | Ni | 147 ppm |
| Nitrogen | 0.82% | V | 490 ppm |
| Sulfur | 5.52% | Na | 497 ppm |
| Ash | 0.27% | K | 4 ppm |
| Moisture | 0.0% | | |
| Oxygen | — | | |
| Total | 100.00% | | |
| B.T.U. content of asphaltene: 17,627/lb | | | |

Although the above asphaltenes may be considered as representative, various other asphaltenes, depending on the source, may have different characteristics.

Based on the above product analysis, it is seen that these products contain considerable amounts of metals. These amounts vary based on the source of the material and may range up to 6,000 parts per million (ppm) of vanadium, but typically up to about 600 ppm. Nickel and other constituents may also be present up to about the last named amount. Consequently, these metals also affect the ability of the residue to be treated by conventional methods of petroleum residue treatment.

Based on the various analyses, typically the hydrogen content of the ORA fraction may range from 13.5% to about 7%, and lower by weight, but again this is not a precise characterization. In a petroleum residue boiling over 1,000° F., the hydrogen content will be about 12.5% and lower. A considerable percentage of "free" carbon is also found (as Conradsen carbon), e.g. up to 45% by weight. The free carbon is defined as Conradsen carbon or Ramsbottom carbon, but these analyses are not identical because different methods are used to define the the "free" carbon which, in fact, may not be "free". In the ORA fraction, Conradsen carbon may range up to 40+%, by weight. In any event, the carbon residue is amenable to conversion according to the process as disclosed herein.

Turning now to the catalyst supports which have been employed, these have been employed mostly for the purpose to obtain increased surface area. The catalyst supports are spinels and such as chromite spinel (CrO) and, most advantageously, porous metal, i.e. stainless steel of the available AISI grades, and the like. The last are obtained by sintering very fine sized uniform, powdered metallurgy particles or are produced as thin plates obtained by leaching out leachable constituents in the thin, (e.g. one eighth of an inch) metal plate, providing thereby intercommunicating passages. Other metal supports are such as are obtained by sintering very fine wires, about 0.2 to 5 mm thick, and cutting these to length, e.g. 2 to 5 mm. Still other supports are such as alumina with sizes of the pores ranging from 50 Å to 350 and even up to 1,000 Å, but these may need to be protected as further explained herein. Although the treatment in subsequent reactors may be less demanding based on support characteristics, the treatment in the original first stage reactor in accordance with this invention is best carried out with a strong, inert support such as the porous metal supports which have a size range of the pores, e.g. up to 3,500 Å and larger, i.e. the metal may be from 10% metal and 90% the pores, by volume, although metal may be up to about 25%, by volume.

In accordance with the present invention, the catalyst in the first stage found to be especially advantageous is a specifically prepared hydrate of an empirical potassium sulfide.

The preparation of this catalyst designated as Catalyst A, is as follows. A mole of potassium hydroxide is dissolved in either ethanol, methanol or a ethanol-methanol mixture, or less advantageously, because of solubility, in 1-propanol or 1-butanol. Solubility of the catalyst product is lower in these last two and larger amounts must be used and subsequently separated. The alkanols may be absolute alkanols, although these may be such as 95% ethanol. The potassium hydroxide is dissolved in this solution and is then reacted with hydrogen sulfide bubbled through the solution. After thorough saturation, the catalyst is recovered by vacuum aspiration. For a mixture, typically one mole of potassium hydroxide is dissolved in 200 cc of ethanol and 130 cc of methanol. Typically, analytical reagent grade pellets of potassium hydroxide (about 86% KOH), 95% ethanol and absolute methanol are used. As mentioned above, the proportions of an ethanol-methanol mixture may be changed.

After the saturation has been completed with hydrogen sulfide, the solution is evaporated under vacuum until no more residual alkanol can be removed. The catalyst may be used as such in the first stage reaction, but most advantageously for the first or subsequent stages it is being deposited on the above mentioned supports and calcined.

In all the reactions the catalyst is allowed to react with the exclusion of atmospheric oxygen and thus in absence of oxygen. Similarly, the deposition of the catalyst on the support is in absence of oxygen as is the driving off of the volatiles from the support.

The catalyst and the support, after the volatiles have been driven off, are heated to an appropriate temperature such as between 320° C. and up to 450° C. or even up to 560° C. The catalyst tightly adheres to the support and is used such as in a spinning-cage (also called spinning basket) reactor, ebullating bed or fluidized bed reactor.

If the support is unduly attacked by the catalyst, such as alumina in the first stage reactor, then the following method is used. The above catalyst is evaporated to considerable dryness, dissolved in glycerol, and the glycerol-catalyst mixture deposited such as on an alumina support. Other less resistant supports to the attack by the catalyst, such as a molecular sieve support, are treated similarly. Typically these molecular sieves may be of the Y and X, e.g. YL-82, type, with low sodium content (available from Union Carbide, Danbury, Conn.). The molecular sieves function, however, as supports for the catalyst, i.e. to increase the surface area of the catalyst.

The glycerol-catalyst mixture after depositing on the reagent may then be progressively heated such as up to 560° C. with the volatiles being driven off.

Glycerol may also be first deposited on the support, which is then heated up to about 200° C., and then the catalyst deposited thereon (after the support has been cooled), and then heated to the desired temperature.

The reaction in the first reactor may be at a higher temperature, and may range from about 320° C. to about 450° C. although temperatures up to 560° C. have been used, even up to 650° C. For asphaltenes, the preferred temperature range is from about 360° C. to about 430° C.; it appears that between 390° C. and 425° C. is a very good operating range.

Inasmuch as the reaction must at all times be conducted in the presence of steam to facilitate the hydrogenation, steam is used in a ratio such that it is about 27% by volume based on the volume of the ORA fraction charged to the above reactor. Conversely, the amount of water charged in the form of steam at the operating temperature may be increased or diminished based on the degree of hydrogenation desired. If more hydrogenation is sought to be achieved, more steam is being introduced, but typically steam does not exceed about 130% by volume of the volume of the hydrogenated product being obtained, i.e. withdrawn (if gaseous fraction is being produced then it is converted to a liquid equivalent). Stated on another basis, the amount of water used is determined by subtracting the hydrogen content of the feedstock from the hydrogen content of the desired product, on weight basis and multiplying the amount by 9 (as water is 1/9 by weight of hydrogen). Typically, a 25% to 30% excess is actually injected in the first reactor.

If water is not being introduced in the reactor, such as in the form of steam, or is interrupted for one reason or another, then coking is apt to occur; thus carbon is being deposited or generated by a process somewhat similar to thermal cracking, but in this event the catalyst acts a thermal cracking catalyst, albeit with some advantage (because this thermal cracking is at a fairly low temperature, e.g. 320° C.), but vastly less efficiently than when it functions in the presence of steam as a hydrogenation-cleavage catalyst.

If carbon is being laid down for one reason or another, typically it is on the hot spots such as heated reactor walls or catalyst support. Hence, the reactor 10 is preferably operated adiabatically. Carbon can be driven off, that is, converted back into useful product by exposure to steam for a prolonged period, after which the catalyst is useful again and can be used for the production of the desired product cut. Intermittent introduction of hydrogen sulfide may be helpful in general for low sulfide content feedstocks.

Intermittent or insufficient steam introduction will also cause the deposition of carbon or production of especially heavy product in the reactor. Hence, it is important that steam is introduced at all times, in a proper manner in the reactor and thoroughly dispersed (without any steam and/or reagent free space).

Nevertheless, it must be mentioned that excessive amounts of steam also prevent the reaction from being carried out appropriately.

Still further, it has been found that if the temperature, such as with the above catalyst, is increased to about 320° C. to 420° C., depending on the asphaltene composition, an exothermic reaction may take place. The exothermic reaction may reach temperatures up to 600° C., but it also depends on the amount of steam being introduced. More steam would tend to produce lighter carbon products.

In the second stage reactor 17 where further reactions take place, advantageously the products from the first reactor, generally between temperatures of 250° C. and 390° C., are rapidly cooled to about 250° C. and in the presence of a catalyst. (Quality of product is increased when the process is operated at temperatures up to about 430° C., preferably 425° C., but the conversion will not increase after 390° C.) Cooling is at such a rate that steam does not condense and interfere with the reaction. The light ends, of course, that is hydrogenated products, will not be condensed. These, if in the form of gases, will be further worked up as shown in the description of the FIGURE or as further explained herein and as it is well known in the art.

The catalyst in the second reactor again is preferably a supported catalyst and the treatment of the products is in a vaporous state, that is gaseous state, or of entrained liquids (in small proportions). A cyclone, or a sieve (not shown), may be used to break an entrainment. A typical catalyst for the second stage reaction, Catalyst B, is produced by dissolving a technical or analytical grade of a potassium hydroxide which is approximately 86% potassium hydroxide in 95% ethanol (preferably ethanol) and saturated with hydrogen sulfide (without boiling off of the alkanol and/or collecting and trapping alkanol in a further vessel. Other vessels) in which the reaction takes place may be further downstream to catch the hydrogen sulfide. When the last vessel containing KOH shows a reaction, the reaction is stopped in all upstream vessels.

If the reaction is carried out in a further reactor(s) 17, i.e. second stage reactors, the advantages of the process reside in the combination obtained by the immediate quenching of the reaction products from the first stage reactor to about 300° C. but preferably 250° C., in the presence of catalyst, and then conducting these reactions on the first stage products in the second stage. For this purpose, it has been found especially advantageous to support the catalyst on a suitable support. These supports may be the same as in the first stage, but in any event these supports must be inert under the reaction conditions in the particular reactor 17 of the type as depicted as in the FIGURE. These second stage reactors 17 are used as fluidized bed (circulatory fluidized bed, partially circulating or confined fluidized bed) or fixed bed reactors.

It has been found acceptable for the second stage reactors to use the supports of a type commonly available such as alumina-alumina silicates of a fixed zeolite type, i.e. molecular sieve type, with sodium or potassium in the zeolite exchanged with ammonia. Type X and Y zeolites ( 10 and 13) are suitable. For type Y molecular sieve zeolites, molar ratio of silica to alumina is about greater than 3 to 1; about 5 to 1, etc.; $Na_{20}$ is about 0.2 weight percent. These are available such as from commercial sources, in forms such as powder spheres, cylindrical and other extrudates, etc., of suitable size such as ⅛ of inch extrudates or spheres. Although these have been alleged to be poisoned or destroyed by alkali metals, as worked up by the below-described procedure, these supports are especially beneficial despite the use of the herein described alkali sulfide reagents.

Other zeolites are ELZ-L zeolite of the potassium type as described in U.S. Pat. No. 3,216,789, and silicalite material as described in U.S. Pat. No. 4,061,724. The last has a pore dimension of about 6 Angstrom units. Other supports are such as those described in British Patent No. 1,178,186, i.e. the very low sodium type—less than 0.7 percent, by weight, e.g. ELZ-Ω-6, or ELZ-E-6, E-8, or E-10. Other supports are mordenites and erionites with very low sodium content obtained by ammonia exchange and of the calcined type. Of the above molecular sieves, the type Y very low sodium, e.g. 0.15, by weight, ammonia exchanged supports available under Trademark LZ-Y82 from sources such as Linde Division, Union Carbide Corporation, Danbury, Conn., Mobil Oil Corporation, New York, N.Y., and other sources are preferred. In any event, the stability and durability of these molecular sieves used as supports are tested under the reaction conditions and are established by the performance in the second stage reactor.

The preparation procedure for the second stage supports is as follows. The low sodium ammonium exchanged zeolite extrudates, such as powders, cylinders, saddles, stars, rings, spheres, etc., of powder, or extrudates of about ⅛ to 5/32 or 3/16 inch size are treated with glycerol or like polyhydroxy alkane compounds, such as partially reacted polyhydroxy compounds including up to hexa-hydric alkanes, by first impregnating these in a reactor which is kept closed. Thereafter, e.g. when using glycerol, by heating and removing decomposition products from these powders, extrudates, or spheres from room temperature up to 265° to 280° and even up to 560° C., an appropriate, but unknown, reaction takes place. The thus reacted support is then screened, drained, and cooled in a closed and tightly sealed container if the temperature has been brought up to 560° C. When cold, the support is then impregnated with a reagent-catalyst of the general formula $K_2S_{1.5}$ (empirical); this catalyst is acceptable, but it is not outstanding. This catalyst is obtained by dissolving 6 moles of KOHA in 1½ to 2½ moles of $H_2O$ per mole of KOH; thereafter 2 to 2.5 cc of methanol or ethanol are added per mole of KOH. Then 4 moles of elemental sulfur are added to the foregoing solution which react exothermically. Thereafter, an appropriate amount of sulfur is added for adjusting the catalyst to the desired sulfur level by addition of additional sulfur to form the empirical sulfide, i.e. from $K_2S$ but $K_2S_{1.1}$ to $K_2S_{2.5}$, including up to $K_2S_5$ is useful, depending on the desired product cut. For more gas in the product, less sulfur saturated species are used. For more liquids in the product, more sulfur saturated species are used.

Another catalyst, Catalyst D, is prepared as follows. One mole of KOH is dissolved in 1.5 moles of water with vigorous stirring. Then 2 ml of methanol or ethanol are added immediately after KOH has dissolved. Immediately thereafter ⅔ moles of elemental sulfur are added and are allowed to react by a vigorous reaction. The catalyst is adjusted to the desired empirical sulfur content by adding appropriate amounts of sulfur by further stirring, e.g. one quarter of ⅔ moles of sulfur adds 0.5 to the empirical sulfur content of $K_2S$; i.e. ¼ of ⅔ moles of dissolved sulfur gives $K_2S_{1.5}$; ½ of ⅔ moles gives $K_2S_{2.0}$, etc., including other appropriate fractions. Thus the catalyst may range from $K_2S_{1.1}$ to $K_2S_{2.5}$ or even up to $K_2S_5$.

When the catalyst has been thus prepared, it is vacuum evaporated to a flowing slurry. It is then poured over the glycerol treated, cooled extrudate as described above (i.e. if the support had been heated up to 300° C. or higher), and under very low vacuum, agitated and aspirated until dry. Then the catalyst is further screened when dry and introduced immediately in the second stage reactor which has been purged of air oxygen.

As another method for protecting the support, if the glyercol treated support is heated between 260° C. to a decomposition point (indicated by slowing down appreciably of liquid condensate), then the above described catalyst slurry is added and the vessel is covered and heated up to at least 450° C., including up to 560° C.

Still another method is to mix the glycerol, e.g. about 88 ml of glycerol, to about the one mole (K basis) of the catalyst, admixing the above catalysts or mixtures thereof. Then the catalyst-glycerol mixture is heated to drive off water and/or alcohol leaving a glycerol solution of the catalyst. Temperature is brought up to 190° C. for the foregoing. The mixture is then poured over the support and with agitation brought up to at least 450° C. and even up to 560° C. This supported catalyst gives a very unpleasant odor. It must be prepared under well isolated conditions.

In use for a gallon-sized first stage reactor in conjunction with a second stage reactor, about ⅔ of mole of supported catalyst (empirical) is charged to the second reactor. As an example, alumina supported $K_2S_{1.5}$ (empirical) catalyst may be charged to the second stage reactor.

Another catalyst, Catalyst E, is a nonsupported or supported catalyst capable of decreasing the molecular size of the product in a first stage reactor (or used in a further second stage reaction). Catalyst E is obtained by adding a dried KHS powder or slurry in appropriate mole or weight percent increments (based on the desired size of the product) to any of the above-described reagent mixtures A, B, C or D. Either unsupported or supported forms of the catalyst may be used. That is from 1/5 to ⅓ moles on molar basis of K of KHS is added to the $K_2S$ (empirical) sulfide, e.g. $K_2S_{1.5}$ (empirical), and the molecular size of the product is decreased by these additions of KHS.

When the process is run with the thus supported catalyst in the second stage reactor, appropriate adjustments may be made, e.g. $K_2S_{1.1}$ or $K_2S_{1.5}$ give more hydrogenation, and $K_2S_2$ gives larger molecules (also more distillate, less gases). These reactions are run in a temperature range from 113° C. to 440° C. Similar catalyst adjustments may be made in other reactors, e.g. when more than one second stage reactor 17 is used. These may also be run at different temperatures. Typically, the temperatures in each subsequent reactor are lower. If more than one second stage reactor is used, the products from each second stage reactor, after quenching of the first stage reaction products, may be run with further cooling, without cooling, or even after heating, and the added second stage reactor(s) may be directly in series or interspersed with coolers and/or heaters in the product stream and run at any of the recited conditions to either hold, lower, or increase the temperature. In any event, the first stage reaction, however, is carried out with the specified reagent due to the refractory, intractable nature of initial source material, e.g. the ORA fraction, and especially asphaltenes and the total process combination in the further, that is second stages, depends on the specified first stage reaction and is thus interdependent.

The amount of catalyst deposited on the support is from about 4M of catalyst (K basis) to about 0.5M or as low as 0.1M (K basis) per 500 cc of carrier.

The life of the supported reagent is a function of the vanadium, iron and nickel content of the petroleum feedstock. The vanadium may be entirely removed from the petroleum feedstock and the heaviest product may contain essentially all of the vanadium. If run with the presently supported catalysts, the vanadium is uniformly analyzed as non-detectable in the No. 2 bottoms. The removal of the nickel is aided if some of the reagent be present in the hydrosulfide form. There is no reaction between the alkali metal sulfides and nickel sulfides but there is a solubility reaction when alkali metal hydrosulfide and nickel sulfides are present. Nickel (and iron) form complexes like ferrites with the alkali metal sulfides-hydrosulfides. These complexes are immediately hydrolyzed in liquid water to form the precipitates of iron or nickel hydroxides. In liquid water, the vanadium complex with the catalyst is highly water soluble and water stable. Iron is normally present in the residue, after distillation range determinations, in amounts between 3 and 5 ppm.

In general, the catalysts for the second stage reaction used herein are the hydrosulfides and sulfides, that is, monosulfides and polysulfides of the Group IA elements of the Periodic Table other than hydrogen prepared from the alkanol solution as mentioned above. Although for the stated purpose sodium, potassium, rubidium and lithium may be used, far and away the most advantageous are sodium and potassium. Of these two, potassium is preferred. Although rubidium compounds appear to be acceptable, rubidium, the same as lithium, is not cost-advantageous. However, for the first stage reactor, rubidium may be very advantageous in a blend of rubidium, potassium and sodium, in the following proportions: 14% rubidium, 26% potassium, and 60% sodium sulfides, i.e. the various species thereof, on basis of the elemental metal, by weight. The ratio ranges for the preceding mixture are 1:1.5–2, 5:3.5–4.5, respectively, but these compositions must be prepared in the manner as defined according to the procedure described for Catalyst A. The catalysts used are typically used as the hydrates, but a small portion of the catalyst is as an alkanolate (the hydrate analogue), i.e. up to about 15% but typically less than 10% or even less than 5%, by weight. As previously mentioned and as it is well known, hydrates (and alkanolates) of these compounds are very complex and undergo a number of transitions during the reaction conditions. No attempt has been made to elucidate the nature of these transitions for the sulfides, hydrates, or the mixtures of each. It is sufficient to indicate, however, that the charged catalyst can be a mixture of a number of hydrates or a eutectic mixture of various hydrates. Similarly, during the reaction, as there is interconversion of the sulfur-containing forms of the sulfides, no attempt has been made to characterize this interconversion. However, as mentioned before, the first stage reaction requires the very specific catalyst, Catalyst A, as defined above.

In the following examples, various reactions are described. There is no intent to limit the invention by the Examples but merely to illustrate its applicability.

EXAMPLE 1

A high softening point asphaltene 270° F. as described below and of a solvent extracted type was treated with the following reagent to obtain product A. The catalyst was Catalyst A previously described. When the product from the first stage treated asphaltenes were reacted in a second stage, the product was identified as B. The second stage catalyst was the same as in the first stage. Both catalyst compositions were unsupported.

| | Feed | Distillate A | Distillate B | Blend A + B | Residue of A + B 600° F. |
|---|---|---|---|---|---|
| Gravity, °API @ 60° F. | −4.6 | 31.3 | 36.7 | 36.0 | 8.7 |
| Kin. Visc. @ 210° F., cST | —* | — | — | 0.94 | 58.0 |
| Con. Carbon Res., wt % | 39.5 | — | — | 0.20 | 16.4 |
| Aniline Point, °C. | — | — | — | 44.6 | — |
| FIA, vol % | | | | | |
| Aromatics | — | — | — | 71.5 | — |
| Olefins | | | | | — |
| Saturates | — | — | — | 28.5 | — |
| Bromine No. | — | — | — | 53 | — |
| Carbon, wt % | 84.24 | — | — | 83.77 | 84.81 |
| Hydrogen, wt % | 8.50 | — | — | 12.52 | 9.95 |
| Nitrogen, wt % | 0.75 | — | — | 0.10 | 0.58 |
| Sulfur, wt % | 6.19 | — | — | 2.31 | 4.46 |
| Ash, wt % | 0.30 | — | — | 0.08 | 0.20 |
| Moisture, wt % | Nil | — | — | 0.05 | Nil |
| Oxygen, wt % | 0.02 | — | — | 1.17 | 0.00 |
| Nickel, ppm(w) | 71 | — | — | — | 33 |
| Vanadium, ppm(w) | 174 | — | — | — | 160 |
| Iron, ppm(w) | 151 | — | — | — | 24 |
| Heptane Insoluble (IP Method) | 16.7 | — | — | — | — |

*270° F. - Softening Point

Aromatics and olefins were not clearly separated in the column probably due to a heavy tail above 600° F.

The above data clearly indicate the considerable improvement in the viscosity as well as the gravity of the products, the dramatic increase of the hydrogen content and the considerable removal of the metals present from the later fractions.

A series of the following examples shows the results obtained. The feedstock charge material was solvent-extracted asphaltenes of the type identified above and in Example I herein.

All of the runs were made as batch-process runs, in a stir-tank reactor. The stir-tank reactor has an inside volume of 6.24" diameter and 10" height. The stir-tank reactor is fitted with an agitator and a steam sparger.

A steam generator, directly connected to the city water supply, forms steam at 40 lb/sq.in. pressure. The steam passes through ⅜" inside diameter lines to the sparger and is at atmospheric pressure. However, the reactor may operate from ½ atm. to about 5 atm.

The sparger is approximately 3½" in diameter and has a series of sparger holes, all of the holes direct the steam upward. The sparger is located on the bottom of the reactor.

An agitator is provided for the reactor when unsupported catalyst is used. The motor is mounted directly above the reactor. A seal seals the area through which the agitator rod passes into the reactor. The agitator is of twin circles connected by angled curved blades. The agitator may be replaced by baskets holding supported catalyst as further described herein. Four baskets containing supported catalyst are mounted on the agitator shaft. The baskets plus the agitator shaft has a total diameter of almost 6.25". The baskets are 6" high and are approximately ½" thick. The unmounted basket is a ½" deep rectangle.

The top of the reactor contains the seal through which the agitator shaft turns, the riser, which exits overhead distillate from the reactor, a pressure relief line, which consists of a valve which opens above 30 lbs/sq.in. pressure and vents the contents of the reactor to a hood. This pressure relief fitting is also used to fill the reactor with solid feedstock charge.

Usually, two thermocouples are fitted into the top of the reactor. One thermocouple measures the temperature at the bottom half of the reactor and the upper thermocouple measures the temperature in the upper half of the reactor.

The riser consists of a line approximately 9" high and having an inside diameter of approximately ¾".

The second stage reactor is a tube reactor having an inside diameter of 1½" and is 12" long. The capacity of this reactor is 347.5 cc. This reactor is fitted with three wrap-around heaters. A thermocouple controls each of the heaters through the controllers, which are mounted on a portable stand.

Gases and vapors passing the up-flow second stage reactor are then conducted downward through a 16" glass bubble condenser. This condenser is not water cooled.

The first condenser is mounted vertically and the bottom of the condenser holds a 500 cc collecting flask. The flask is normally maintained at 240° C. by a mantel type heater. The bottom of the flask has a stop cock for collecting product.

A second condenser rises from the above flask and is parallel with the first condenser. The second condenser is not cooled by water. The second condenser is also a glass condenser with bubble type cooling areas.

The downward slanting tube from the second condenser connects to a water-cooled condenser. This water-cooled condenser is mounted vertically and is approximately 18" long; it fits into the top of an unheated 500 cc flask which is fitted with a stop-cock at the bottom. A parallel vertical water-cooled condenser rises from the second fitting in this flask. Another water-cooled condenser is fitted directly above this condenser.

The top water-cooled condenser is fitted with a 12" long line which angles upwardly. This line has a diameter between ½" and ¾". This line connects to an ice cooler.

The ice cooler is a twin wall vessel, ordinarily used to trap vapors before they can enter a vacuum pump. The center container contains a water-ice mixture while the gases and vapors pass through the external container section. The gases and vapors enter at the bottom of the vessel and exit at the top of the vessel. The bottom of the vessel contains a 50 cc collector. The collector is fitted with a stopcock, for removing product.

The remaining gases and vapors are sent to another cooler, similar to the ice cooler. This cooler is cooled by a mixture of solid carbon dioxide and 2-propanol. The product is again collected in a 50 cc vessel below the cooler and this vessel is fitted with a stopcock.

The remaining gases and vapors are then washed in a solution of potassium hydroxide. The solution contains 6 moles of KOH dissolved in 360 ml of water. The gases are then measured by passage through a wet test meter. After this measurement, samples are periodically collected and the uncollected gases are vented to the hood.

For the following runs, 1300 grams of the solid asphaltenes are weighed out and crushed to a size to charge the reactor. Liquid or solid catalyst protected from oxygen is then added to the reactor, previously purged, e.g. with helium. About 40 grams of theoretical anhydrous Catalyst A is charged to the reactor.

The secondary reactor is charged, again with the same precaution, usually with about 300 cc of a supported catalyst. The secondary reactor is initially heated, in order to drive out the water content of both the zeolite support and the catalyst.

After the water content of the secondary reactor space has been reduced by bringing the temperature of the second reactor to above 300° C., the primary reactor is heated.

Solvent-extracted asphaltenes having melting points of either 200° or 400° F. were used. The melting point determines the particular form of the asphaltenes.

After temperature adequate to melt the asphaltenes were reached in the primary reactor, the agitator was turned on. Normally the agitator is initially operated at approximately 30 to 60 rpm.

Steam is normally introduced when the primary reactor reaches a temperature of 220° C. By this time, the second stage reactor should have reached or leveled off to 424° C.

Helium is normally sparged through the sparger prior to the introduction of steam to the system in order to keep the sparger holes clear and the system free of oxygen. The helium is sparged at approximately 200 cc/minute.

EXAMPLE II 1300 grams of the solvent-extracted asphaltenes were reduced in size so that they could pass through the 1" opening in the top of the reactor. The asphaltenes were not heated but were charged to the reactor in solid form; the reactor was sparged with helium.

The catalyst used was another version of Catalyst A prepared as follows. To the previously described initial solution of KOH was added a solution of one mole KOH dissolved in 30 cc of $H_2O$ and then the solution mixture saturated with hydrogen sulfide. The solution separates in two layers about ⅓ top layer and ⅔ bottom layer. The layers are separated and dried and then the two proportions reblended. The reblending may be in the same proportions as obtained (as it was in this Example), or the proportions of the two catalysts may be varied. The catalyst may also, upon reblending, be dissolved or dispersed for deposition on a support. On a theoretically anhydrous condition, the weight of charged catalyst was approximately 40 grams.

The second stage reactor had been charged with zeolite supported catalyst during apparatus assembly. The second stage reactor contained approximately 300 grams of support and catalyst. The zeolite support was L2-Y82 and the catalyst was catalyst D, i.e. $K_2S_{1.5}$, to enhance the hydrogenation of the cleaved product. The start-up procedure requires that the secondary reactor be brought to at least 175° C. before the primary reactor is heated.

The first stage reactor was then heated. Only the bottom one-half of the reactor is heated, the top half of the reactor is not heated. At 220° C., a small amount of steam was added to the reactor through the bottom sparger.

At approximately 320° C., in the bottom of the first stage reactor, there began a steady but slow production of hydrocarbon product, which was condensed in the flask below the twin water-cooled condensers. However, this product was much heavier than the product obtained at process-temperatures, in the 390° C. to 424° C. range.

When the bottom of the first stage reactor reached 360° C., there was a considerable improvement in the rate of product production. The reaction became exothermic and rose rapidly and leveled off at about 415° C. This temperature was maintained from that time forward in the bottom of the reactor. The top of the reactor had reached 360° C.

The temperatures in the second stage reactors are in the 220° C. to 460° C. range.

When the contents of the first stage reactor were in contact with the agitator, the process ran uniformly at about 415° C. in the first stage reactor and with variations between 440° and 460° C. in the second stage reactor.

The amount of steam was estimated at approximately 20 cc of water converted to steam/minute. At the end of the run, the top and bottom temperatures in the primary reactor were allowed to rise to 440° C.

Catalyst A above variation described above gave almost no gas through the wet test meter. The amount of gas was less than 6 liters.

The bulk of product was the No. 2 bottoms, collected below the water-cooled condensers. This product, when combined with the product collected below the water-ice trap totalled 458 grams. This product had an API number of 23 (sp.gr. @60° F. 0.9158).

The No. 1 bottoms totalled 33 grams and had a gravity of 0.96587 (API number 15) @60° F. The No. 1 bottoms were collected below the air-cooled condensers.

The amount of bottoms collected below the dry ice-2-propanol cold trap measured 44 cc in the calibrated trap. However, when collected, only 28 cc were obtained due to the evaporation of these light ends. The API gravity of these light ends was 81 @−10° C. (sp.gr. @−10° C. =0.6553). Due to rapid evaporation this gravity is very imprecise.

An extraordinarily light coke was formed and formed 2Δ thick layers in the reactor. This coke measured 1800 cc but had a weight of 513 grams.

The dead space below the agitator causes a delayed coking operation below the true reaction zone.

EXAMPLE III

This example was carried out in a similar manner to that of Example II with the exception of a different form of the catalyst and a more rapid start-up heating of the first stage reactor.

Catalyst A for this example was a single layer catalyst and did not require the layer separation during the drying phase that was used for the catalyst used in Example II above. The sustained temperature of this run was 420° C.

In the 42 minutes of this run, after achieving process-temperature (at about 420° C.), the catalyst, approximately 40 grams on a theoretically anhydrous basis, converted the following bottoms from the initial 1300 gram solvent-extracted asphaltene charge:

(a) No. 1 bottoms, collected below the air-cooled condensers, totalled 29 grams of a hydrocarbon, having an API gravity of 11.5 (sp.gr. of 0.9895 @60° F.).

(b) No. 2 bottoms, collected below the water-cooled condensers and the water-ice condensers, totalling 398 grams of hydrocarbon, having an API gravity of 29 (sp.gr. @60° F.=0.8816).

(c) No. 5 bottoms, collected below the dry ice-2-propanol cold trap, totalled 63 cc with a gravity of 83 at ambient temperatures. A substantial part of the No. 5 bottoms were lost in determining this API gravity.

(d) A total of 135 liters of gas were produced. The gases were measured following the alkali hydroxide wash of the gas-vapors (following the dry ice-2-propanol cold trap). These gases were not collected for analysis, but the average analysis of similar runs produced approximately 5% (volume percent) non-hydrocarbon gases, such as hydrogen, carbon monoxide and carbon dioxide. The remaining hydrocarbon gases have an average molecular weight of 49; on this basis a total weight of 280 grams of hydrocarbon can be assigned to the gas obtained.

(e) The same light coke as formed in Example II was observed in the reactor following this run. The weight of the coke was 489 grams.

The accounted for weights are:

| | | |
|---|---|---|
| No. 1 Bottoms | 29.0 grams | |
| No. 2 Bottoms | 398.0 grams | |
| No. 5 Bottoms | 41.5 grams | (Cold trap) |
| Gases | 280.0 grams | |
| Coke | 489.0 grams | |
| Total | 1,238.0 grams | Accountability = 95.23% |

Conversion = Nos. 1, 2, 5 bottoms + gas/feedstock charge = 57.57%

For both Examples II and III the supported catalyst of the second reactor was completely clean and free of pitch, carbon, etc.

The total accountability for products obtained by Example II was 1,045.7/1300=80.42%. The conversion, i.e. the Nos. 1,2,5 bottoms+-gases=532.7/1300=40.97%.

The principal difference between the two Examples was the much higher gas production in Example III.

In these two examples, the bottoms completely separated from the water, condensed from the steam and no emulsion was formed.

EXAMPLE IV

In this Example, a blend of catalyst was used, i.e. about ⅔ of the catalyst was that described of Example II, but not separated, ⅓ catalyst of Example III (K basis).

The various proportions may be changed, including the proportions of the catalyst layers in Example II. The catalyst was unsupported and was about 40 grams on a theoretically anhydrous basis.

The reactor reached a temperature of 420° during this run.

The products obtained during this run were:

| | | |
|---|---|---|
| No. 1 Bottoms | 195.8 grams | (sp. gr. 0.9793 @ 60° F. or API 13) |
| No. 2 Bottoms | 309.5 grams | (sp. gr. = 0.86 @ 60° F. or API 33) |
| No. 5 Bottoms | 28.0 grams | |
| Gas | 276.4 grams | (133 liters × 0.95/22.4 × 49 = 276.4 grams) |
| Coke | 473.0 grams | |
| Total | 1,282.7 grams | |
| Accountabilty = 1,282.7/1300 = 98.67% | | |
| Conversion (Nos. 1,2,5 bottoms + gas = 809.7 grams/1300 grams) = 62.28%. | | |

It was apparent that the coke formation was from the 480 cc of space below the agitator and some of this space is also below the sparger.

EXAMPLE V

The principal difference between this Example and the previous Examples was the use of a supported catalyst instead of unsupported catalyst being added prior to the beginning of the run. The catalyst was supported on stainless steel sintered mesh in four baskets. The stainless steel was ⅛" thick and had been cut into ⅛" strips which were in turn cross-cut for 3/16" sizes. The support size was therefore ⅛"×⅛"×3/16". The catalyst was the same catalyst as used in Example II.

The supported catalyst was placed in ¼"× 2.5"×6" baskets, 4 baskets were used and the baskets were supported and turned by the agitator shaft. The baskets became the agitator. A mesh held the supported catalyst in place and the wire mesh baskets were supported by a frame.

With the same catalyst as in Example II (and considerably less of the catalyst in the supported form) the amount of gas produced decreased from 135 liters to 90 liters. Most of this gas was produced during the end of the run when the temperatures rose to 440° C.

The speed of the agitator which spun the baskets was initially 60 rpm and later in the run was increased to 120 rpm.

| | | |
|---|---|---|
| Gas | 187.0 grams | (90 liters of gas × 0.95/22.4 × 49 = 187.0) |
| No. 1 bottoms | 407.0 grams | |
| No. 2 bottoms | 368.0 grams | |
| No. 5 bottoms | 43.0 grams | |
| Coke | 199.5 grams | |
| Total | 1,204.5 grams | |

The feedstock charge of the solvent-extracted asphaltenes was 1290 grams. Accountability=1204.5 grams/1290 grams=93%. Conversion=Nos. 1, 2, and 5 bottoms+gas/1290=77.90%.

The API number of the combined No. 2 and No. 5 bottoms was 32.0@60° F. Of the No. 1 bottoms, a division was made between the part which was liquid at 200° C. and that which was not liquid at 200° C. The liquid portion had a calculated API number of 5 and this portion constituted 228 grams of the 407 grams of total No. 1 bottoms, or 56.03%. The remainder appear to be slightly upgraded forms of the solvent extracted asphaltenes. Recalculation of the conversion based on the liquid portion @200° C. of the No. 1 bottoms give a conversion of 64%.

In all these conversions and accountability estimates, the gas produced is calculated at 95% hydrocarbon, of a hydrocarbon of an average molecular weight of 49.

It is evident that, when the feedstock charge is below the sparger, a competitive process is operational. It involves a decreased temperature catalytic thermal cracking with an improved threshold limit for thermal cracking, i.e. when steam is not present along with the catalyst. When the catalyst is supported, there is no coke formation if steam, the asphaltene feed, and the catalyst are in intimate contact with each other. If insufficient steam, or no steam reaches the asphaltene feed, then the reaction turns into a catalytically aided thermal cracking. Although carried out at lower temperature then normal thermal cracking, at about atmospheric pressure, and at about a rate 10 times faster than normal thermal cracking, the catalytic hydrocracking-hydrogenation is vastly more desirable because of the high yields, high space velocities, desirable, adjustable product composition and the reaction conditions.

What is claimed is:

1. In a process for converting carbonaceous materials to products of lower viscosity and/or end products that are more hydrogenated, said converting being the presence of alkali metal sulfide catalysts and without adding hydrogen gas serving substantially as a hydrogenation reactant, the improvement comprising:

(a) reacting, at a temperature of up to about 600° C. in the presence of added stream, added in an amount of up to 130%, based on the end products being withdrawn, an oil, or resin or asphaltene fraction of a distillate having a boiling point of at least 850° F.+, or mixtures thereof, with a supported or unsupported catalyst composition comprising:

(1) a first solution of an alkali metal hydroxide dissolved in methanol, ethanol, 1-propanol or 1-butanol or mixtures of these alkanols, or (2) a second solution of said alkali metal hydroxide-alkanol as defined in (1) above to which water dissolved alkali metal hydroxide has been added and wherein the ratio of said first solution to said alkali metal hydroxide, on a mole bases, in said solutions is from 0.5:1 to 1:0.5, said first or second solution being treated with hydrogen sulfide, such that in either solution (i) a single phase solution forms, or (ii) a two phase solution forms, said catalyst composition being said single phase solution of (i), said two phase solution of (ii), each of the phases of (ii), taken individually, mixtures of the phases of (ii) with each other, a mixture of each of the individual phases of (ii) with the single phase solution of (i), or a mixture of the two phases of (ii) with each other taken with the single phase of (i), and removing the residual solvent from the foregoing and (b) recovering reaction products from step (a), including gases produced in the reaction.

2. The process as defined in claim 1 wherein the reaction products of step (a) are reacted further with or without intermediate cooling of the reaction products, in at least one additional reaction zone, in presence of a supported catalyst and said added steam, wherein the supported catalyst comprises an alkali metal hydrosulfide, sulfide, polysulfide, a hydrate of a sulfide, a hydrate of a polysulfide, or mixtures thereof, prepared by (a) saturation with hydrogen sulfide of an alkanol dissolved alkali metal hydroxide, (b) sulfur addition to an alkanol dissolved alkali metal hydroxide or (c) sulfur addition to a combined alkanol dissolved and water dissolved alkali metal hydroxide solution.

3. The process as defined in claim 1 wherein the catalyst in step (a) is a supported catalyst and the support is a porous metal, chromite spinel, or an alumina.

4. The process as defined in claim 1 wherein the catalyst in step (a) is a porous metal supported catalyst and said porous metal is a stainless steel of up to 35% metal by volume.

5. The process as defined in claim 1 wherein the carbonaceous material reacted in step (a) is an asphaltene and the supported catalyst is the single phase catalyst porduct defined as (i), deposited on said catalyst support and heated up to a temperature of about 560° C.

6. The process as defined in claim 1 wherein the catalyst is supported on a porous metal support and wherein the reaction is at a temperature from 360° C. to 450° C.

7. The process as defined in claim 1 wherein the reaction is carried out at a pressure from subatmospheric to 5 atm. and at a temperature from about 160° C. to about 600° C., in presence of a catalyst supported on a porous metal support said catalyst composition is deposited on said support and said support is heated, in absence of oxygen, at a temperature up to about 580° C. before reacting an oil, resin, and/or asphaltene fraction with said catalyst.

8. The process as defined in claim 2 wherein the catalyst for the second stage is a catalyst composition as defined by (a), (b) or (c) in claim 2 in an admixture with KHS in proportions of 0.25:1 to 1:1, on basis of K, mole basis, and the resultant admixture is deposited on a porous stainless steel support.

9. The process as defined in claim 1 wherein the catalyst is a supported catalyst and the support is alumina of a pore size up to 1,000A, said alumina being protected from an attack by said catalyst by (a) depositing said catalyst on said support in an admixture with glycerol, or (b) depositing on said support a polyhydric alkanol of up to six carbon atoms, heating said support up to 200° C., cooling said support, and then depositing said catalyst on said support, either dissolved in an alkanol or said polyhydric alkanol of up to six carbon atoms, and, thereafter, heating said support and catalyst up to about 560° C.

10. The process as defined in claim 2 wherein the catalyst for the further reaction is supported and wherein said support is a porous metal, chromite spinel, alumina, a zeolite, or a mixed support.

11. The process as defined in claim 1 wherein the carbonaceous material is solvent extracted asphaltene of a softening point of about 270° F.

12. The process as defined in claim 1 wherein after reaction in step (a) and recovery of the product from step (a), part of said product is recycled to step (a).

13. The process as defined in claim 1 wherein the reaction in step (a) is carried out at a temperature up to 600° C.

14. The process as defined in claim 2 wherein at least two further reaction zones are provided after step (a), each with a catalyst as recited in claim 2, and each zone being at a lower temperature than the preceding reaction zone and wherein reaction products of an oil, resin, and/or asphaltene are reacted in said zones.

15. The process as defined in claim 14 wherein the reaction products of an asphaltene fraction are reacted in said further reaction zones immediately after step (a) while the reaction products from step (a) are quenched to a lower temperature from a temperature at which the reaction products and effluents are obtained from step (a).

16. The process as defined in claim 1 wherein the reaction is in an ebullient bed.

* * * * *

UNITED STATES PATENT AND TRADEMARK OFFICE

CERTIFICATE OF CORRECTION

PATENT NO. : 4,468,316

DATED : August 28, 1984

INVENTOR(S) : ROLLAN SWANSON

It is certified that error appears in the above-identified patent and that said Letters Patent is hereby corrected as shown below:

On the first page of the patent, delete the assignment data, item No. 73.

In the ABSTRACT, line 2, after "petroleum," delete "* or other hydro- *."

In the ABSTRACT, line 3, before "refining," delete "* carbon *."

In col. 8, line 61, delete "$Na_{20}$," and insert "$Na_2O$."

In col. 9, line 43, delete "KOHA" and insert "KOH."

Signed and Sealed this

Sixth Day of August 1985

[SEAL]

*Attest:*

DONALD J. QUIGG

*Attesting Officer*

*Acting Commissioner of Patents and Trademarks*